US011982050B2

(12) United States Patent
Choi

(10) Patent No.: US 11,982,050 B2
(45) Date of Patent: May 14, 2024

(54) CABLE USING COLD-DRAWN SHAPE MEMORY ALLOY WIRES AND METHOD FOR MANUFACTURING THE SAME

(71) Applicant: Hongik University Industry-Academia Cooperation Foundation, Seoul (KR)

(72) Inventor: Eun Soo Choi, Seoul (KR)

(73) Assignee: Hongik University Industry-Academia Cooperation Foundation, Seoul (KR)

( * ) Notice: Subject to any disclaimer, the term of this patent is extended or adjusted under 35 U.S.C. 154(b) by 78 days.

(21) Appl. No.: 17/394,952

(22) Filed: Aug. 5, 2021

(65) Prior Publication Data

US 2022/0341093 A1 Oct. 27, 2022

(30) Foreign Application Priority Data

Apr. 26, 2021 (KR) ..... 10-2021-0053870

(51) Int. Cl.

| | |
|---|---|
| ***D07B 1/06*** | (2006.01) |
| ***D07B 5/00*** | (2006.01) |
| ***E04C 5/08*** | (2006.01) |
| *E01D 101/28* | (2006.01) |

(52) U.S. Cl.

CPC ..... *D07B 1/0693* (2013.01); *D07B 5/00* (2013.01); *E04C 5/08* (2013.01); *D07B 2201/2009* (2013.01); *D07B 2201/2066* (2013.01); *D07B 2501/2023* (2013.01); *E01D 2101/28* (2013.01)

(58) Field of Classification Search

CPC ..... D07B 1/0693; D07B 5/00; D07B 2201/2009; D07B 2201/2066; D07B 2205/3805; D07B 2501/2023

See application file for complete search history.

(56) References Cited

U.S. PATENT DOCUMENTS

| | | | | |
|---|---|---|---|---|
| 5,344,315 | A * | 9/1994 | Hanson | A61C 7/20 433/20 |
| 6,278,057 | B1 * | 8/2001 | Avellanet | C25B 15/08 174/128.1 |
| 2001/0025475 | A1 * | 10/2001 | Ouchi | A61B 1/0052 57/224 |
| 2001/0028431 | A1 * | 10/2001 | Rossin | G02C 5/00 351/83 |
| 2005/0059994 | A1 * | 3/2005 | Walak | A61F 2/0105 606/78 |
| 2008/0223015 | A1 * | 9/2008 | Okamoto | D07B 1/062 57/212 |

(Continued)

FOREIGN PATENT DOCUMENTS

KR 10-2055986 B1 12/2019

*Primary Examiner* — Shaun R Hurley

(74) *Attorney, Agent, or Firm* — Studebaker & Brackett PC

(57) ABSTRACT

The present invention relates to a cable using cold-drawn shape memory alloy wires, which facilitates concrete pre-stressing or other operations, and has excellent adhesion to concrete and manufacturability. The cable using cold-drawn shape memory alloy wires includes: a core wire configured by a cold-drawn shape memory alloy deformed by cold drawing to have an increased length; and a plurality of peripheral wires configured by cold-drawn shape memory alloy wires which are deformed by cold drawing to have an increased length and are couple to the core wire while being wound in a same direction along the circumference of the core wire.

2 Claims, 8 Drawing Sheets

(56) References Cited

U.S. PATENT DOCUMENTS

| | | | | |
|---|---|---|---|---|
| 2008/0307723 | A1* | 12/2008 | Smith | F16F 15/03 52/167.8 |
| 2009/0226691 | A1* | 9/2009 | Mankame | D07B 5/00 428/222 |
| 2012/0324858 | A1* | 12/2012 | Browne | E01D 19/16 57/212 |
| 2018/0105981 | A1* | 4/2018 | Matsumoto | D07B 1/10 |
| 2018/0148893 | A1* | 5/2018 | Matsumoto | F16C 1/00 |
| 2021/0102335 | A1* | 4/2021 | Mitchell | A61B 34/71 |

* cited by examiner

CABLE USING COLD-DRAWN SHAPE MEMORY ALLOY WIRES AND METHOD FOR MANUFACTURING THE SAME

BACKGROUND OF THE INVENTION

1. Field of the Invention

The present invention relates to improvement of a cable and a method for manufacturing the same and, more particularly, to improvement of a cable using a shape memory alloy and a method for manufacturing the same.

2. Description of the Prior Art

In general, a shape memory alloy (SMA) is capable of exhibiting a shape memory effect and thus recovering from a deformation. The shape memory effect of a shape memory alloy will be described briefly with reference to FIG. 1 to FIG. 3.

FIG. 1 is a diagram for describing a transformation process of a shape memory alloy. FIG. 2 is a diagram illustrating a stress-strain curve of a shape memory alloy. FIG. 3 is a graph for describing recovery stress of a shape memory alloy.

Referring to FIG. 1, if an external force is applied to deform a shape memory alloy in a twinned martensite state, the shape memory alloy reaches a detwinned martensite state. If heat is applied to the shape memory alloy in this state to raise the temperature thereof, the same transforms to an austenite state. As the temperature drops, the shape memory alloy returns to the original twinned martensite state, thereby recovering from the deformation.

The process in which the shape memory alloy recovers from deformation will be described in more detail with reference to FIG. 2 and FIG. 3 together. Referring to FIG. 2, if the shape memory alloy is deformed, and if the stress is then removed, a degree of elastic recovery occurs from the deformation, but the rest is not recovered and remains as residual deformation. If heat is applied to raise the temperature of the shape memory alloy which has residual deformation, the deformation fully recovers from the residual deformation. However, if heat is applied while deformation is restrained as in FIG. 3, stress occurs with no recovery from the deformation, and this is referred to as recovery stress.

In general, the recovery stress occurring in a shape memory alloy decreases, in the case of a NiTi shape memory alloy, if the temperature drops to a room temperature, and increases, in the case of a Fe-based shape memory alloy, if the temperature drops.

As an example of utilization of a shape memory alloy having the above-mentioned characteristics, Korean Registered Patent Publication No. 10-2055986 (entitled "STRUCTURE REPAIR/REINFORCEMENT UNIT"; inventors: Jung Chi-Yung et al.; Date of registration: Dec. 9, 2019) discloses "a structure repair/reinforcement unit including: an extension member having a first electric resistance and a first magnetic permeability; a shape memory alloy member having a second electric resistance smaller than the first electric resistance and a second magnetic permeability smaller than the first magnetic permeability, the shape memory alloy member contacting the extension member; and an induction heating unit configured to heat the extension member, wherein, if the extension member is heated, heat is transferred from the extension member to the shape memory alloy member in a heat conduction type".

In the above invention by Jung et al., the shape memory alloy member needs to be deformed, in order to cause the shape memory effect, by directly tensioning multiple strands of shape memory alloy member. However, such direct tensioning of multiple strands of shape memory alloy requires a large amount of tension and is ineffective, and it is therefore impossible to practically use the same on a construction site or the like. For example, if deformation is introduced by directly tensioning a wire made of multiple strands of shape memory alloy, equipment capable of applying a large amount of tension is necessary, and the equipment also needs to be very long to tension the same.

In addition, in the above invention by Jung et al., multiple strands of shape memory alloy wires with smooth surfaces are used as they are in a straight state. Accordingly, the invention of Jung et al. has a disadvantage in that when a recovery stress is generated in a state of being disposed inside the concrete, slip occurs because the adhesive force to the concrete is small, and the recovery stress is reduced. Such characteristics make it inevitable to use a fixing device for fixing ends of the cable to concrete, according to the invention by Jung et al.

SUMMARY OF THE INVENTION

It is an aspect of the present invention to provide a shape memory alloy cable which does not require large-capacity tensioning equipment because it is unnecessary to directly tension the cable in the field when the same is applied to confinement of concrete, closing and treatment of concrete cracks, concrete prestressing, or the like, and which has excellent field applicability.

It is another aspect of the present invention to provide a shape memory alloy cable having excellent adhesion to concrete.

It is still another aspect of the present invention to provide a method for manufacturing a shape memory alloy cable.

A cable according to the present invention includes: a core wire configured by a cold-drawn shape memory alloy deformed by cold drawing to have an increased length; and a plurality of peripheral wires coupled to the core wire while being wound in a same direction along the circumference of the core wire, and configured by a cold-drawn shape memory alloy deformed by cold drawing to have an increased length.

The core wire and the plurality of peripheral wires may be both formed using cold-drawn shape memory alloy straight wires configured straightly.

The core wire is preferably formed using a cold-drawn shape memory alloy straight wire configured straightly, and the plurality of peripheral wires are preferably formed using cold-drawn shape memory alloy corrugated (or crimped) wires having corrugations formed on a surface thereof.

If necessary, the core wire and the plurality of peripheral wires may be both formed using cold-drawn shape memory alloy corrugated wires having corrugations formed on a surface thereof.

If necessary, a cable according to the present invention includes: a first cable according to one of the above-mentioned cables; and a plurality of second cables according to one of the above-mentioned cables, which are wound in a same direction along the circumference of the first cable.

The first cable may be preferably a cable in which the core wire and the plurality of peripheral wires are both formed using cold-drawn shape memory alloy straight wires configured straightly, and the second cables are preferably cables in which: i) the core wire is formed using a cold-drawn shape memory alloy straight wire configured straightly, and the plurality of peripheral wires are formed using cold-drawn shape memory alloy corrugated wires having corrugations formed on a surface thereof, or ii) the core wire and the plurality of peripheral wires are both formed using cold-drawn shape memory alloy corrugated wires having corrugations formed on a surface thereof.

If necessary, both the first cable and the second cables may be the cables in which the core wire and the plurality of peripheral wires are formed using cold-drawn shape memory alloy straight wires configured straightly.

If necessary, both the first cable and the second cables may be the cables in which: i) the core wire is formed using a cold-drawn shape memory alloy straight wire configured straightly, and the plurality of peripheral wires are formed using cold-drawn shape memory alloy corrugated wires having corrugations formed on a surface thereof, or ii) the core wire and the plurality of peripheral wires are formed using cold-drawn shape memory alloy corrugated wires having corrugations formed on a surface thereof.

A method for manufacturing a cable according to the present invention includes: preparing a plurality of peripheral wires configured by cold-drawn shape memory alloy wires deformed by cold drawing to have an increased length; preparing a core wire configured by a cold-drawn shape memory alloy deformed by cold drawing to have an increased length; and winding the plurality of peripheral wires in a same direction along the circumference of the core wire so as to couple the peripheral wires to the core wire.

The preparing of the plurality of peripheral wires may include preparing cold-drawn shape memory alloy straight wires configured straightly, and the preparing of the core wire may also include preparing a cold-drawn shape memory alloy straight wire configured straightly.

The preparing of the plurality of peripheral wires preferably includes preparing cold-drawn shape memory alloy corrugated wires having corrugations formed on a surface thereof, and the preparing of the core wire preferably includes preparing a cold-drawn shape memory alloy straight wire configured straightly.

If necessary, the preparing of the plurality of peripheral wires may include preparing cold-drawn shape memory alloy corrugated wires having corrugations formed on a surface thereof, and the preparing of the core wire may also include preparing a cold-drawn shape memory alloy corrugated wire having corrugations formed on a surface thereof.

A method for manufacturing a cable according to the present invention may include: preparing a first cable according to one of the above-mentioned cables; preparing a plurality of second cables according to one of the above-mentioned cables; and winding the plurality of second cables in a same direction along the circumference of the first cable so as to couple the second cables to the first cable.

The preparing of the first cable preferably includes preparing the cable in which the core wire and the plurality of peripheral wires may be both formed using cold-drawn shape memory alloy straight wires configured straightly, and the preparing of the second cables preferably includes preparing the cable in which i) the core wire is formed using a cold-drawn shape memory alloy straight wire configured straightly, and the plurality of peripheral wires are formed using cold-drawn shape memory alloy corrugated wires having corrugations formed on a surface thereof, or ii) the core wire and the plurality of peripheral wires are formed using cold-drawn shape memory alloy corrugated wires having corrugations formed on a surface thereof.

If necessary, the preparing of the first cable and the preparing of the second cables may include preparing the cables in which both the core wire and the plurality of peripheral wires may be formed using cold-drawn shape memory alloy straight wires configured straightly.

In addition, if necessary, the preparing of the first cable and the preparing of the second cables may include preparing the cables in which i) the core wire is formed using a cold-drawn shape memory alloy straight wire configured straightly, and the plurality of peripheral wires are formed using cold-drawn shape memory alloy corrugated wires having corrugations formed on a surface thereof, or ii) the core wire and the plurality of peripheral wires are formed using cold-drawn shape memory alloy corrugated wires having corrugations formed on a surface thereof.

According to the present invention, it is unnecessary to directly tension a cable in the field when applied to confinement of concrete, closing and treatment of concrete cracks, concrete prestressing, or the like, thereby providing field applicability and facilitating the prestressing operation.

According to the present invention, it is unnecessary to directly tension a cable in the field, and therefore, a tensioning equipment having a large-capacity and a long length for tensioning the cable is not required.

According to an embodiment of the present invention, the cable has excellent adhesion to concrete or cement composite material, thereby making it unnecessary to install a fixing device or an anchoring device at an end for prestressing.

The present invention may provide a cable which facilitates concrete prestressing or other operations.

The present invention may provide a cable which facilitates concrete prestressing or other operations, and which has excellent adhesion to concrete or the like.

BRIEF DESCRIPTION OF THE DRAWINGS

The above and other aspects, features and advantages of the present invention will be more apparent from the following detailed description taken in conjunction with the accompanying drawings, in which.

DETAILED DESCRIPTION OF THE EXEMPLARY EMBODIMENTS

Hereinafter, preferable embodiments of the present invention will be described in detail with reference to the accompanying drawings.

Figure 1:
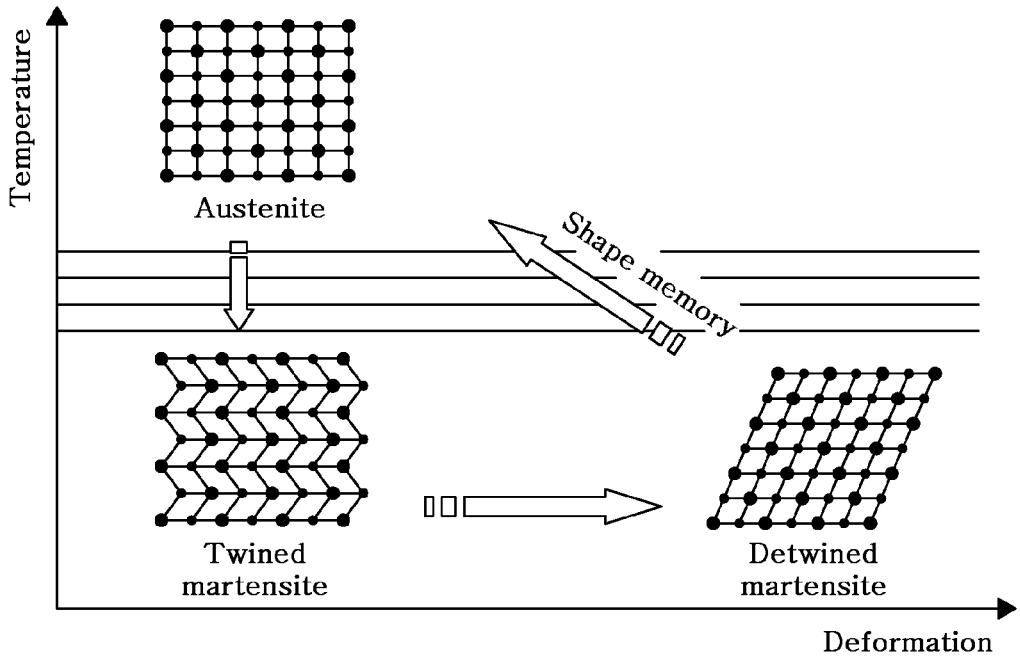
FIG. 1 (PRIOR ART)
FIG. 1 is a diagram for describing a transformation process of a shape memory alloy.
Figure 2:
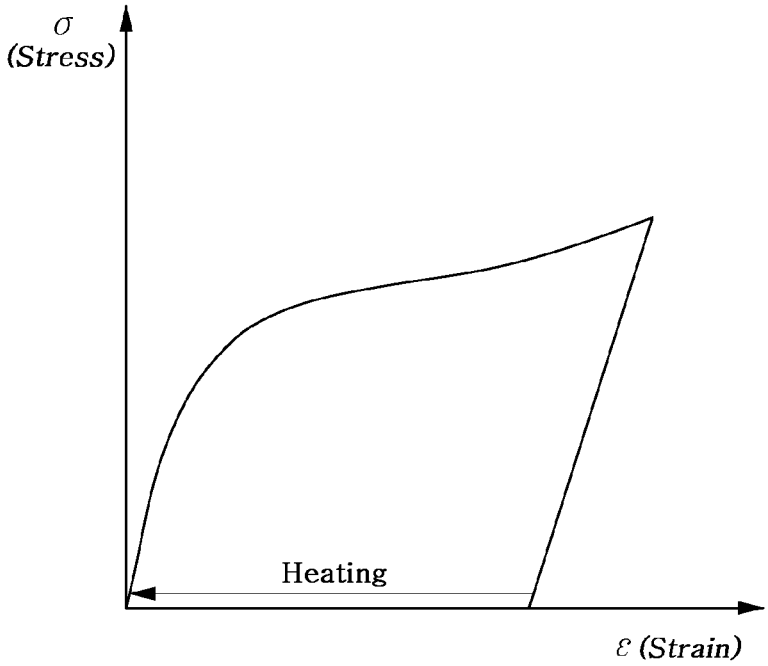
FIG. 2 (PRIOR ART)
FIG. 2 is a diagram illustrating a stress-strain curve of a shape memory alloy.
Figure 3:
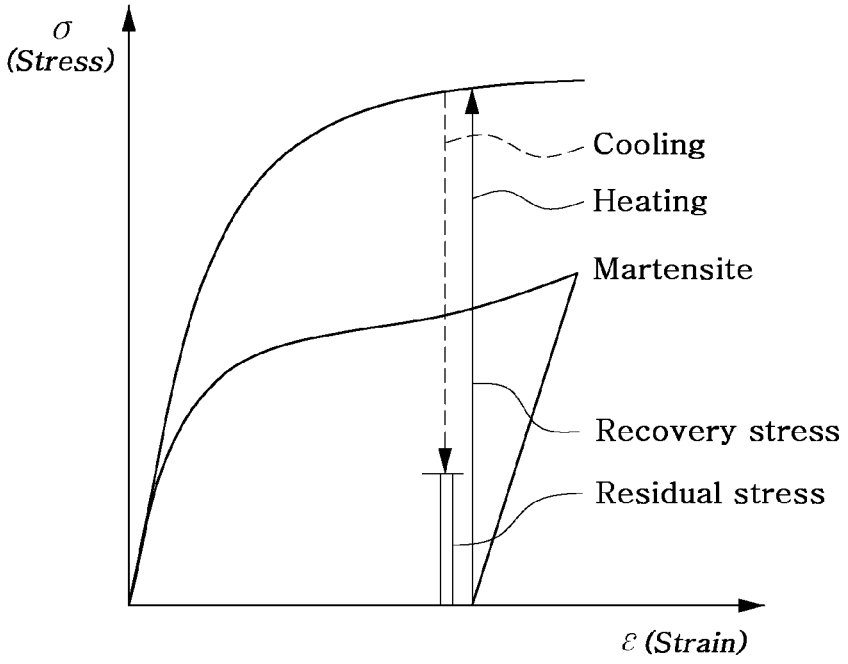
FIG. 3 (PRIOR ART)
FIG. 3 is a graph for describing recovery stress of a shape memory alloy.
Figure 4:
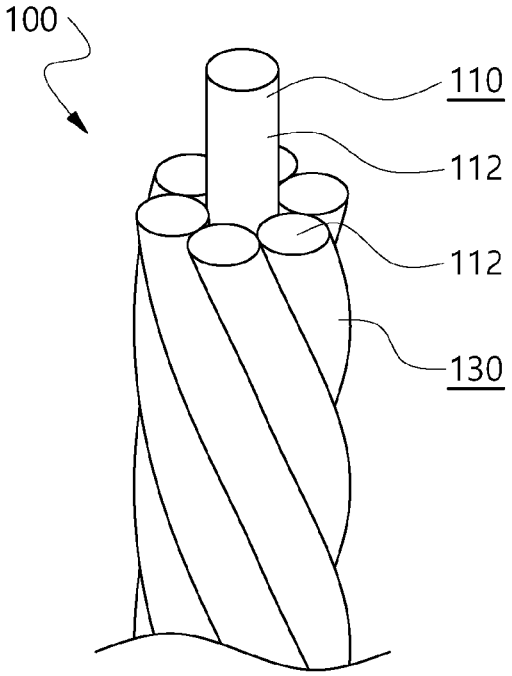
FIG. 4 is a perspective view illustrating an example of a cable using a shape memory alloy according to the present invention.
Figure 5:
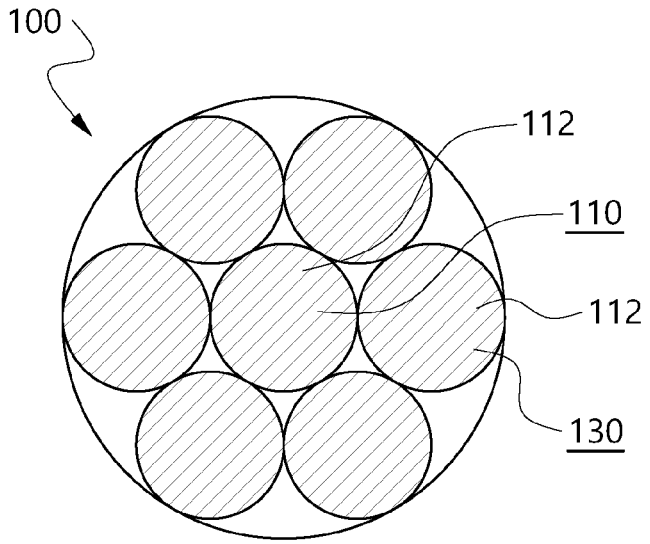
FIG. 5 is a cross-sectional view of the cable shown in FIG. 4.
Figure 6:
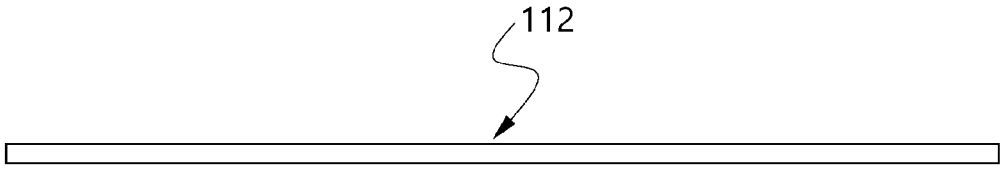
FIG. 6 is a side view illustrating an example of a cold-drawn shape memory alloy straight wire.

FIG. 4 is a perspective view illustrating an example of a cable using a shape memory alloy according to the present invention, FIG. 5 is a cross-sectional view of the cable illustrated in FIG. 4, and FIG. 6 is a side view illustrating an example of a cold-drawn shape memory alloy straight wire.

With reference to FIGS. 4 to 6, a cable 100 according to the present invention has a core wire 110 and peripheral wires 130.

The core wire 110 is preferably made of a cold-drawn shape memory alloy straight wire 112 deformed by cold drawing to have an increased length. This is to use the principle that deformation occurs in the longitudinal direction when a shape memory alloy wire undergoes a cold drawing process, and accordingly recovery stress is generated by a shape memory effect. The shape memory alloy straight wire 112 can be continuously manufactured in a factory, and thus can be very effectively manufactured regardless of the length.

FIG. 6 illustrates an example of the cold-drawn shape memory alloy straight wire 112 which may be used as the core wire 110 and/or the peripheral wires 130. This embodiment shows that a straight wire having a smooth surface without corrugations thereon is used as both the core wire 110 and the peripheral wires 130.

As shown in FIG. 5, the cable 100 according to the present invention includes: the core wire 110 configured by the cold-drawn shape memory alloy straight wire 112; and the plurality of peripheral wires 130 configured by the cold-drawn shape memory alloy straight wires 112 and coupled to the core wire 110 while being wound in the same direction along the circumference of the core wire 110. Although the cable 100 in this embodiment has a low adhesion to the concrete, compared with that in an embodiment illustrated in the following FIG. 9, the cable 110 requires no separate tensioning device that has a large capacity and a long length for tensioning a cable in the field, and enables easy prestressing operation on a concrete structure and the like in the field.

This embodiment describes the 1×7 cable 100 which is manufactured using seven cold-drawn wires, but the number of peripheral wires 130 may vary. According to circumstances, the number of core wires 110 of the cable (100) may be also increased.

A manufacturing process of the cable 100, illustrated in FIG. 5, includes: preparing the plurality of cold-drawn shape memory alloy straight wires 112; and winding the plurality of cold-drawn shape memory alloy straight wires 112 in the same direction along the circumference of the cold-drawn shape memory alloy straight wire 112 in the center to couple same to the cold-drawn shape memory alloy straight wire 112 in the center.

Figure 7:
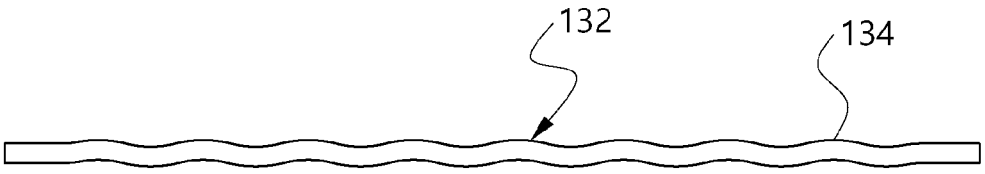
FIG. 7 is a side view illustrating an example of a cold-drawn shape memory alloy corrugated wire.
Figure 8:
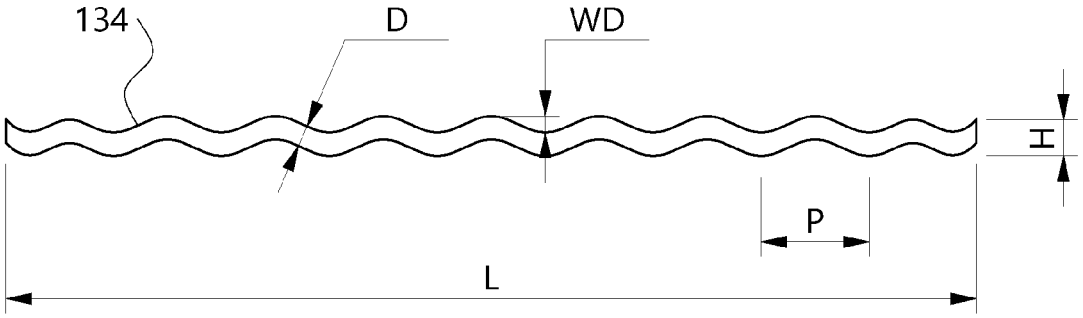
FIG. 8 is a side view exaggeratingly illustrating corrugations to describe the configuration of a cold-drawn shape memory alloy corrugated wire.
Figure 9:
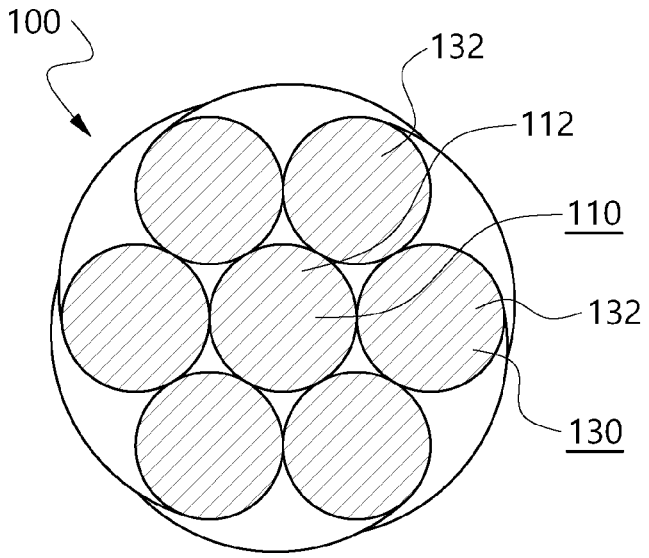
FIG. 9 is a cross-sectional view illustrating another example of the wire according to the present invention.
Figure 10A:
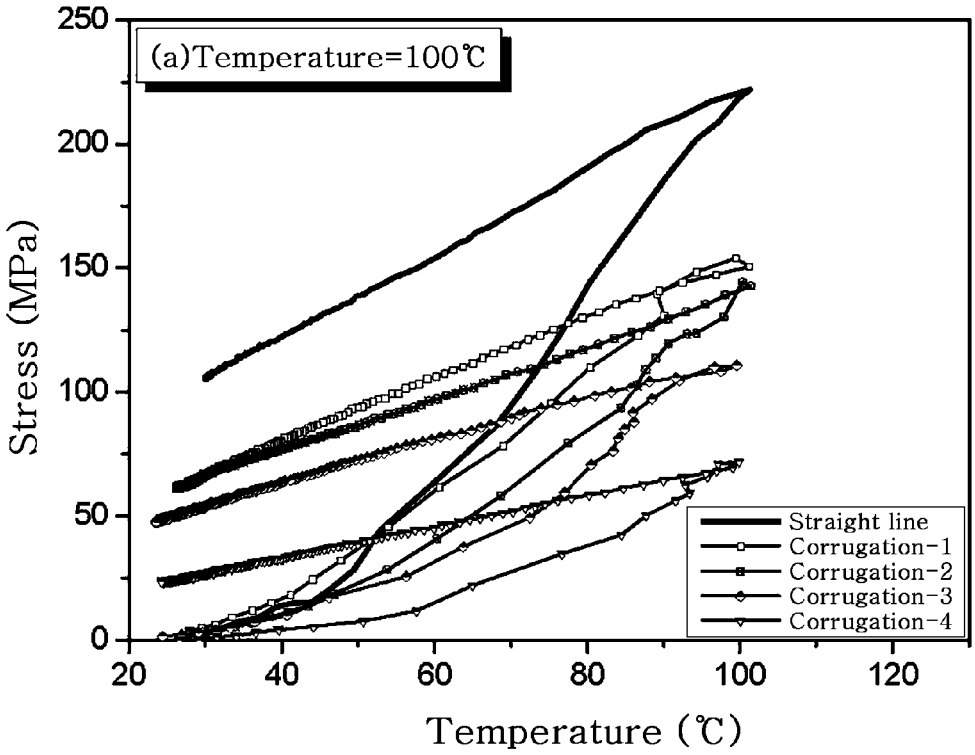
FIG. 10A, FIG. 10B, FIG. 10C, and FIG. 10D are graphs at temperatures of 100° C., 150° C., 200° C., and 300° C., respectively, showing the results of a recovery stress expression test for the cold-drawn shape memory alloy straight wire shown in FIG. 6 and the cold-drawn shape memory alloy corrugated wire as shown in FIG. 7.
Figure 10B:
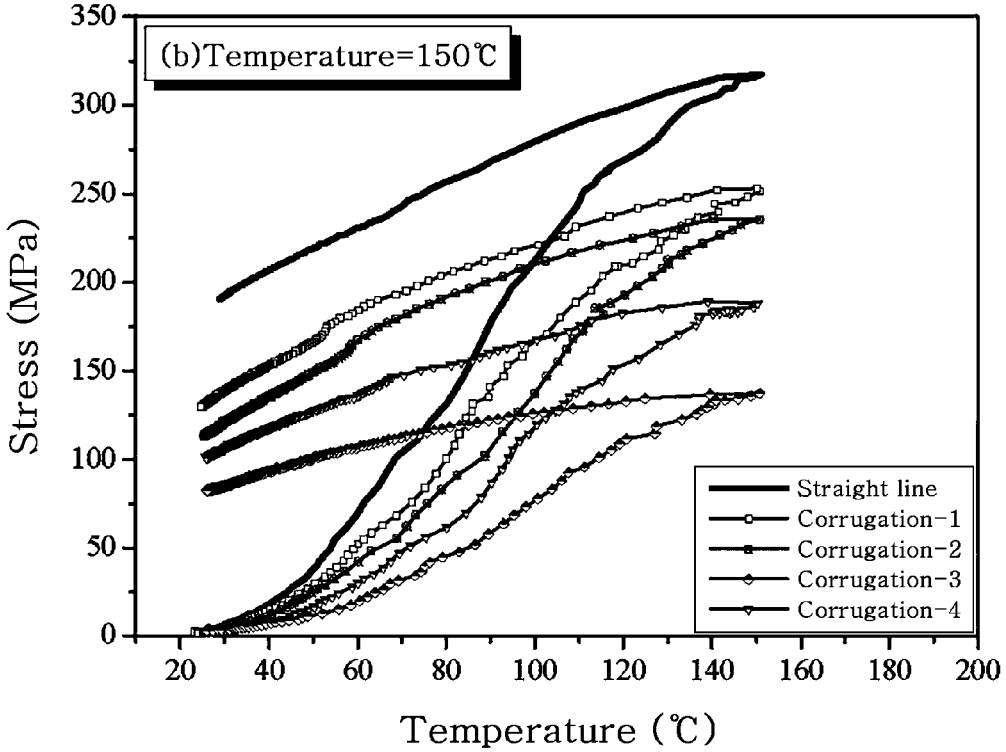
Figure 10C:
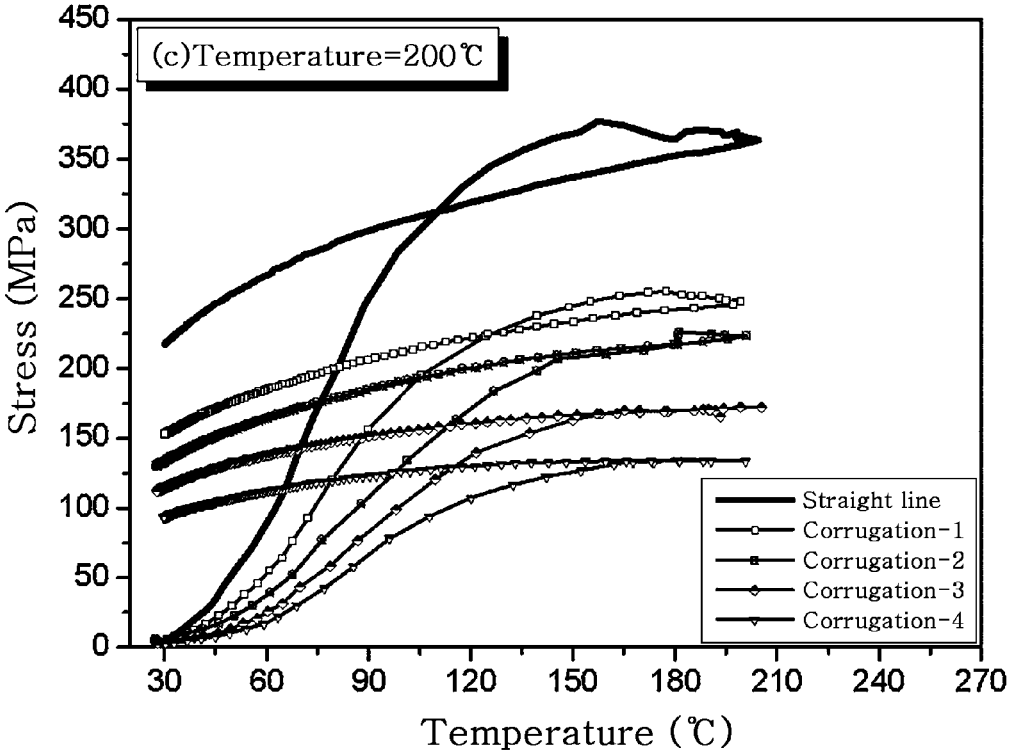
Figure 10D:
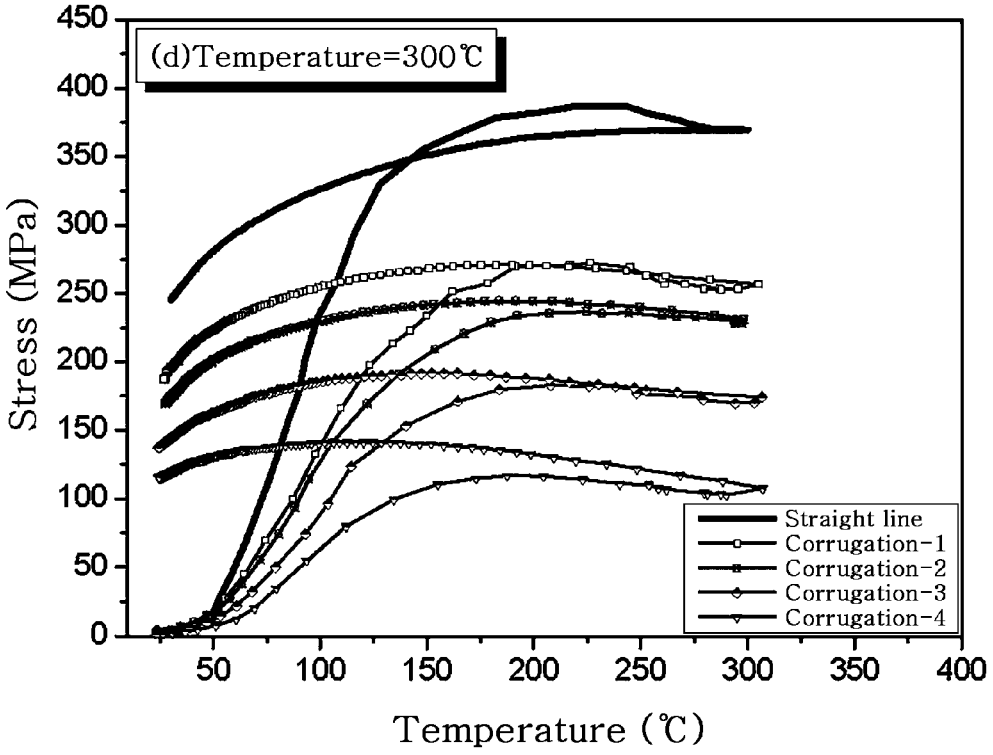

FIG. 7 is a side view illustrating an example of a cold-drawn shape memory alloy corrugated wire, FIG. 8 is a side view exaggeratingly illustrating corrugations to describe the configuration of the cold-drawn shape memory alloy corrugated wire, and FIG. 9 shows another example of a cable according to the present invention. Description will be given with reference to FIGS. 4 to 6 together.

The description of the core wire 110 in FIGS. 7 to 9 is the same as that described in FIGS. 4 to 6.

As illustrated in FIG. 7, a cold-drawn shape memory alloy corrugated wire 132 deformed by cold drawing to have an increased length and including corrugations formed on the surface thereof is used as the peripheral wires 130.

The cold-drawn shape memory alloy corrugated wire 132, which enables to overcome shortcomings of the cold-drawn shape memory alloy straight wire 112 having a low adhesion inside the concrete or cement composite material, preferably has corrugations 134 formed on the surface thereof by crimping a shape memory alloy straight wire deformed by cold drawing in the longitudinal direction.

An example of the cold-drawn shape memory alloy corrugated wire 132 is shown in FIGS. 7 and 8. FIG. 8 illustrates that if the diameter (or thickness) of the peripheral wire 130 is D (0.966 mm), the corrugations 134 have a pitch P of about 3.4D (3.3 mm) and a height H of about 1.08D (1.039 mm), and a wave depth WD between the corrugations 134 is about 0.038D (0.037 mm).

However, the pitch of the corrugations 134 of the cold-drawn shape memory alloy corrugated wire 132, the height of the cold-drawn shape memory alloy corrugated wire 132, and the wave depth between the corrugations 134 thereof, which are described above, may change within a range in which excessive flexion is not formed. Excessive flexion leads to a limit at which no recovery stress occurs. However, it is difficult to define the limit in a standardized manner.

In a case where a temperature of the cold-drawn shape memory alloy corrugated wire 132 is increased, when the wire is fixed, the deformation given in the longitudinal direction generates recovery stress by a recovery characteristic according to the property of recovering the original deformation by transformation. However, the flexion deformation by the corrugations 134 causes the wire to be straightened to the original shape to have an increased length and thus becomes a factor of reducing the occurrence of stress in the fixed state. Therefore, if the recovery stress by the deformation recovery in the longitudinal direction is smaller than the stress reduction by the straightening of the flexion, the recovery stress does not occur. Therefore, the wire should be manufactured by appropriately adjusting the size of the flexion to adjust the stress reduction by the straightening, so as to increase the adhesion strength by the flexion and express recovery stress at the same time. However, a limit value for the flexion by corrugations can be determined by a test according to the type of material used for a shape memory alloy, the requirements of the field, or the like. Further, the limit value is different according to the type of material used for the shape memory alloy, the pitch of the corrugations, the characteristic of each shape memory alloy wire, the requirements of the field, or the like. Thus, it is difficult to define the limit value in a standardized manner.

As noted from the above description, a process for manufacturing the cable 100 illustrated in FIG. 9 includes: preparing the cold-drawn shape memory alloy straight wire 112 and the plurality of cold-drawn shape memory alloy corrugated wires 132, which are described above; and winding the plurality of cold-drawn shape memory alloy corrugated wires 132 in the same direction along the circumference of the cold-drawn shape memory alloy straight wire 112 in the center to couple the same to the cold-drawn shape memory alloy straight wire 112 in the center.

As in the previous embodiment, the cold-drawn shape memory alloy straight wire 112 may be used as both the plurality of peripheral wires 130 and the core wire 110. However, in a case where high adhesion is required, as described in this embodiment, it is preferable to manufacture the cable according to the present invention by using the cold-drawn shape memory alloy corrugated wire 132 as the plurality of peripheral wires 130 and using the cold-drawn shape memory alloy straight wire 112 as the core wire 110.

According to circumstances, the cable 100 may be manufactured using the cold-drawn shape memory alloy corrugated wire 132 illustrated in FIG. 7 for both the core wire 110 and the peripheral wires 130. In this case, the cable 100 has almost the same adhesion to the concrete as that shown in FIG. 9 and is superior to that shown in FIG. 5. However, since the peripheral wires 130 cannot be radially symmetrically arranged due to the core wire 110 having corrugations, the manufacture thereof may be more difficult than the manufacture shown in FIG. 9.

FIG. 10A to 10D are graphs showing the results of a recovery stress expression test for the cold-drawn shape memory alloy straight wire shown in FIG. 6 and the cold-drawn shape memory alloy corrugated wires as shown in FIG. 7.

drawn shape memory alloy corrugated wires 132 using a heat gun, followed by cooling.

As a temperature of the cold-drawn shape memory alloy corrugated wires 132 or the cold-drawn shape memory alloy straight wire 112, which are to be tested, rises to exceed a transformation temperature. As at which martensite starts to change to austenite, recovery stress occurs, and when the temperature reaches the final transformation temperature Af, the recovery stress is maximized. If heat above the final transformation temperature Af is continuously applied thereto, the wire to be tested expands, thus reducing the stress.

The recovery stress characteristics shown in FIGS. 10A to 10D represent the characteristics of specific shape memory alloy wires and are not general. Table 1 (measured value before a test, unit: mm) and Table 2 (measured value after a test, unit: mm) below show the thickness, the wave depth between corrugations, and the height of each shape memory alloy wire, before and after the test.

Referring to FIGS. 10A to 10D and Tables 1 and 2 below, when the wires are heated at the same temperature, the cold-drawn shape memory alloy straight wire 112 has the greatest recovery stress, and the greater the flexion, the less the recovery stress expression. This is because, as described above, the stress decreases as the flexion portion caused by the corrugations 134 expands. Therefore, the excessive flexion leads to a limit at which no recovery stress occurs.

TABLE 1

| Classification | Straight line | Corrugation-1 | Corrugation-2 | Corrugation-3 | Corrugation-4 |
|---|---|---|---|---|---|
| Diameter or thickness (D) | 0.955 | 0.965 | 0.966 | 0.971 | 0.972 |
| Height (H) | — | 1.017 | 1.039 | 1.077 | 1.138 |
| Depth to trough (WD) | — | 0.052 | 0.073 | 0.106 | 0.166 |
| Length | — | 50.36 | 50.22 | 50.54 | 50.39 |

TABLE 2

| Classification | Straight line | Corrugation-1 | Corrugation-2 | Corrugation-3 | Corrugation-4 |
|---|---|---|---|---|---|
| Diameter or thickness (D) | 0.971 | 0.973 | 0.974 | 0.977 | 0.976 |
| Height (H) | — | 1.000 | 1.014 | 1.037 | 1.087 |
| Depth to trough (WD) | — | 0.027 | 0.040 | 0.060 | 0.111 |
| Length | — | 49.38 | 49.55 | 49.93 | 49.88 |

In FIGS. 10A to 10D, "straight line" represents the cold-drawn shape memory alloy straight wire 112 shown in FIG. 6, and "corrugation-1" to "corrugation-4" represent the cold-drawn shape memory alloy corrugated wires 132 as shown in FIGS. 7 and 8, showing that a wave depth between the corrugations 134 increases as the number increases, thereby having increased flexion. All four graphs are different in the temperature range on the horizontal axis and/or in the stress range on the vertical axis.

Figure 11:
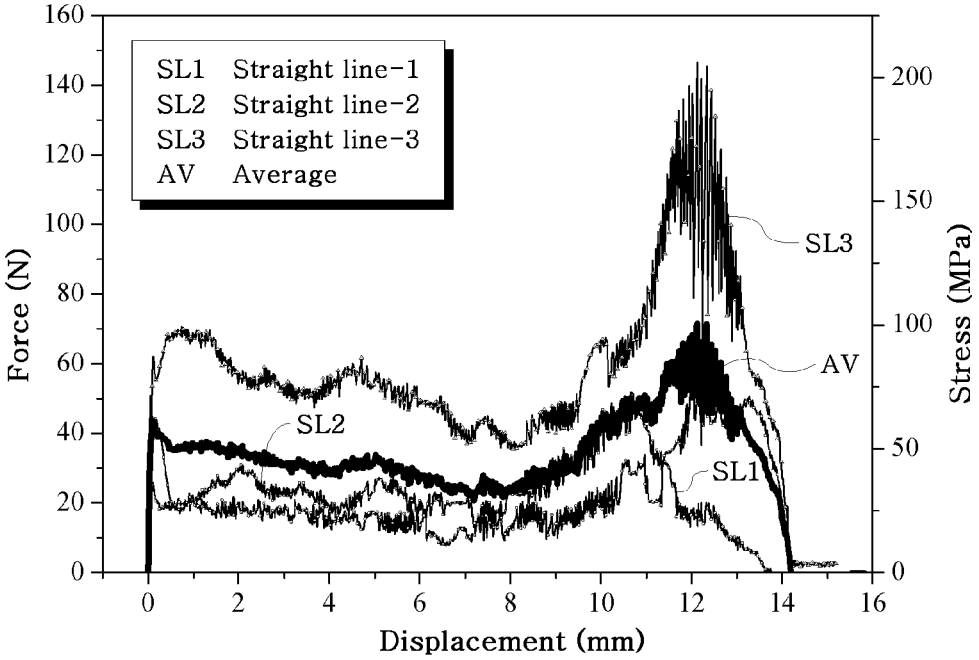
FIG. 11 is a graph showing adhesion performance of cold-drawn shape memory alloy straight wires.
Figure 12:
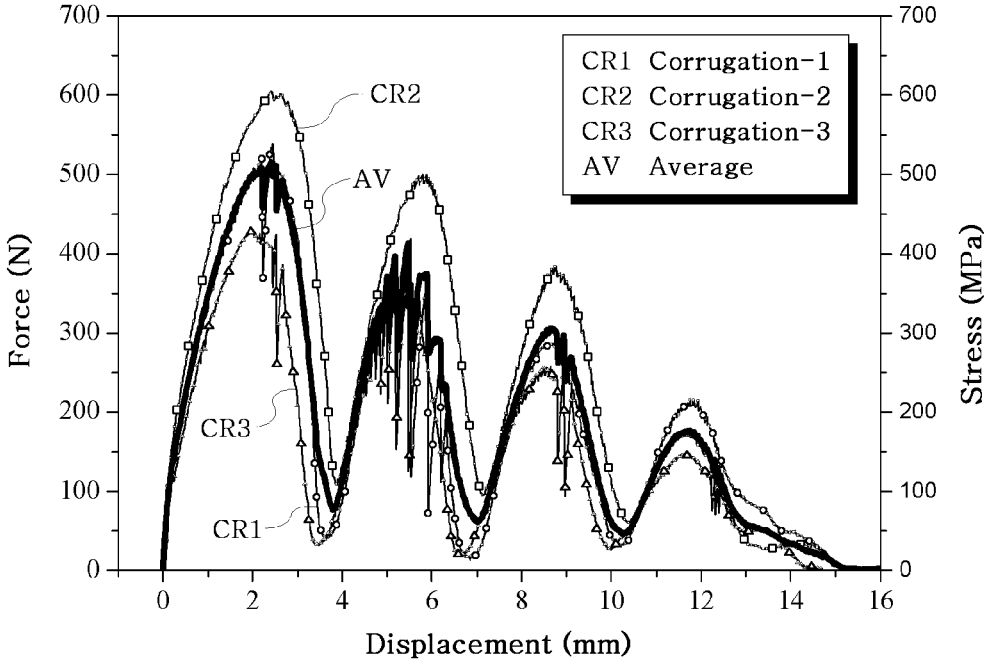
FIG. 12 is a graph showing adhesion performance of cold-drawn shape memory alloy corrugated wires.

The specification as shown in Table 1 has been obtained through a test method performed by: fixing the cold-drawn shape memory alloy straight wire 112 and the cold-drawn shape memory alloy corrugated wires 132 to a tensile tester respectively, and then forming a chamber around the wire to be tested and attaching a thermometer for measuring the wire temperature thereto; and applying heat to the cold-drawn shape memory alloy straight wire 112 and the cold- FIG. 11 is a graph showing an adhesion performance of cold-drawn shape memory alloy straight wires, and FIG. 12 is a graph showing adhesion performance of cold-drawn shape memory alloy corrugated wires. Description will be given with reference to FIGS. 4 to 9 together.

As shown in FIG. 11, the cold-drawn shape memory alloy straight wire 112 begins to be pulled out at a stress of about 39-70 MPa, but referring to FIG. 12, the cold-drawn shape memory alloy corrugated wires 132 shows adhesion strength of up to 600 MPa. The cold-drawn shape memory alloy corrugated wires 132 show adhesion performance increased about 10 times in comparison with the cold-drawn shape memory alloy straight wire 112. This adhesion performance advantageously enables a shape memory alloy wire disposed inside the cement composite material or concrete to move integrally with the cement composite material and the like.

Therefore, when the cold-drawn shape memory alloy corrugated wires 132 are brought into contact with concrete to introduce prestressing into the concrete, predetermined prestressing can be effectively introduced into the concrete without slipping due to strong adhesion stress thereof.

Meanwhile, although the cold-drawn shape memory alloy straight wire 112 generates slightly large recovery stress in the test, when the cold-drawn shape memory alloy straight wire 112 is placed inside the concrete to induce recovery stress therefrom, the recovery stress thereof is decreased due to the slipping caused by the low adhesion stress thereof. Due to this characteristic, in a case where the cold-drawn shape memory alloy straight wire 112 is placed on the surface, a fixing device for fixing an end thereof to the concrete may preferably be used.

Figure 13:
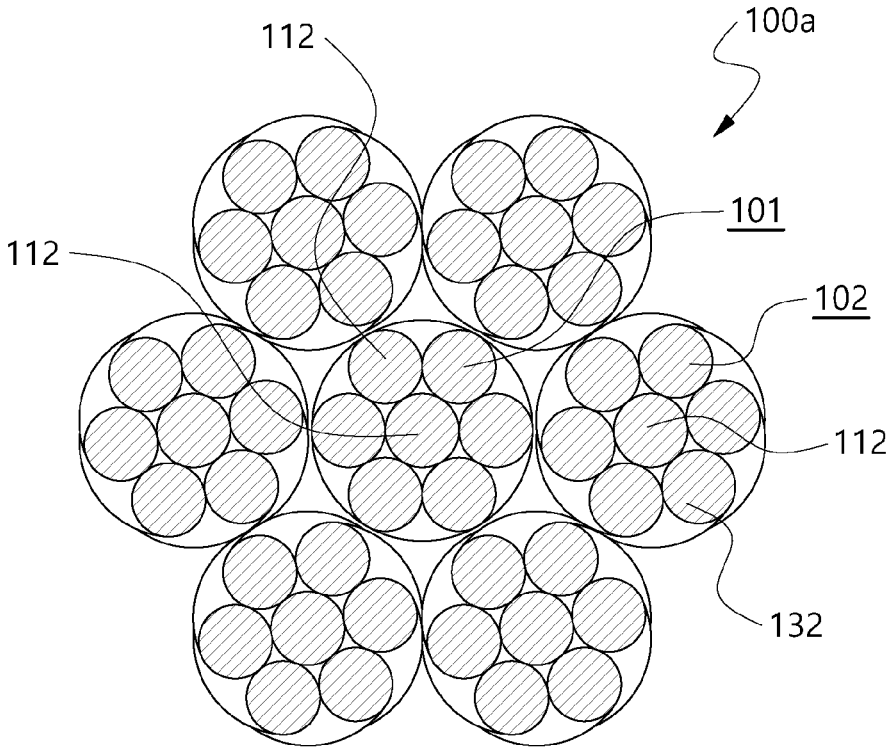
FIG. 13 is a cross-sectional view showing another example of a cable according to the present invention.

FIG. 13 is a cross-sectional view showing another example of a cable according to the present invention.

According to circumstances, a cable 100*a* according to the present invention may include: a first cable 101 formed of the cable shown in FIG. 5, which is disposed in the center; and a plurality of second cables 102 formed of the cable shown in FIG. 9, which are coupled to the circumference of the first cable 101 while being wound in the same direction along the circumference of the first cable 101.

In a case of manufacturing the 7×7 cable 100*a* according to this embodiment, as shown in FIG. 13, the cable shown in FIG. 5 is used for the first cable 101 in the center, and the cable shown in FIG. 9 is used for the peripheral second cables 102, thereby obtaining the effect of simultaneously enabling easy manufacture and enhancing adhesion strength. The cable 100*a* according to this embodiment requires no installation of a fixing device or an anchoring device at the end during prestressing.

Figure 14:
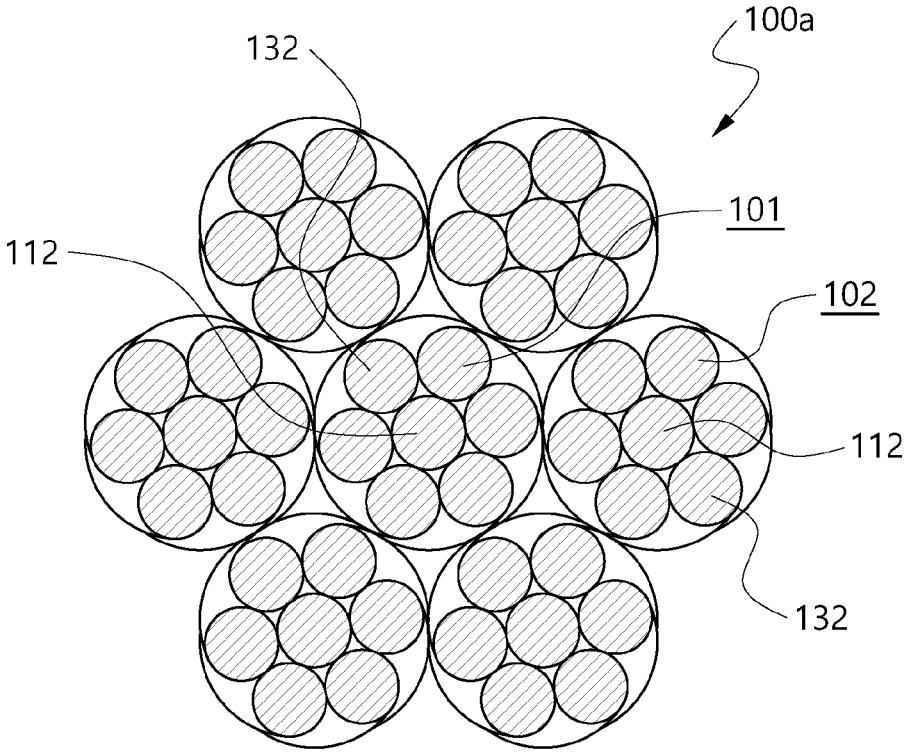
FIG. 14 and FIG. 15 are cross-sectional views, respectively, illustrating other examples of cables according to the present invention.
Figure 15:
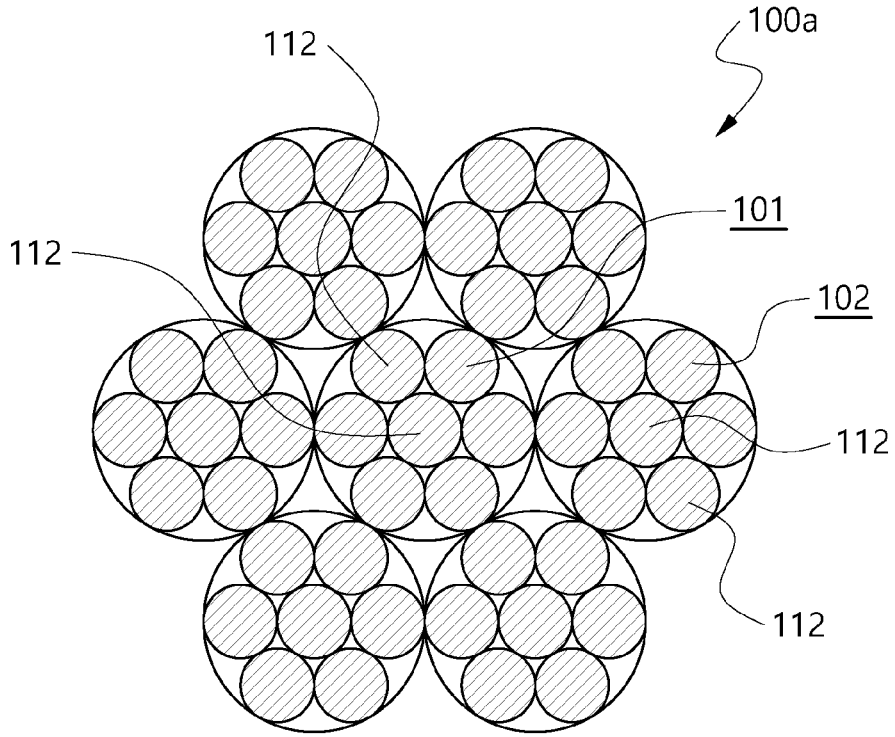

FIGS. 14 and 15 are cross-sectional views showing another example of a cable according to the present invention.

According to circumstances, both the first cable 101 and the second cables 102 may be configured by the cable shown in FIG. 9 or the cable shown in FIG. 5.

That is, as shown in FIG. 14, both the first cable 101 and the second cables 102 may be configured by the cable shown in FIG. 9. In this case, since the cold-drawn shape memory alloy corrugated wires 132 are used for both the first cable 101 and the second cables 102, the manufacture thereof becomes slightly difficult compared to the manufacture of that of FIG. 13. However, there is no need to install a fixing device or an anchoring device at the end due to the high adhesion strength thereof.

According to circumstances, as shown in FIG. 15, both the first cable 101 and the second cables 102 may be configured by the cable shown in FIG. 5. In this case, since both the first cable 101 and the second cables 102 are manufactured using straight wires, the cable 100*a* has advantages of being easily manufactured and generating relatively large recovery stress, but a fixing device or an anchoring device may be preferably installed at the end due to the low adhesion strength thereof.

As noted from the above, the cable 100*a* can be manufactured by arranging the first cable 101 in the center, which is formed of any one of the cables as shown in FIGS. 5 and 9, and winding the plurality of second cables 102, which are formed of any one of the cables as shown in FIGS. 5 and 9, in the same direction along the circumference of the first cable 101 to couple same to the first cable 101.

The cable according to the present invention, described above, can be used in a post-tensioning method of the PSC girder. A process thereof is as follows.

First, the cables 100 and/or 100*a* according to the present invention are arranged in a mold along the curve. In this case, there is no need for a sheath used in the past.

Second, after casting and curing concrete, when electricity is applied to both ends of each of the cables 100 and/or 100*a* according to the present invention upon the expression of a predetermined concrete strength, recovery stress is generated on the cables 100 and/or 100*a* by a shape memory effect as a temperature of the cables 100 and/or 100*a* rises due to the resistance thereof, and accordingly, the recovery stress causes the concrete to be prestressed.

When prestressing is introduced using the post-tensioning as above, the prestressing can be introduced into a PSC girder placed on the ground and can be introduced even into the PSC girder mounted on a bridge pier since electricity can be supplied thereto.

Therefore, a first prestressing is introduced on the ground into some of the cables 100 and/or 100*a* according to the present invention, and then a second prestressing can be introduced on the bridge pier into the remaining cables 100 and/or 100*a* according to the present invention sequentially after an additional fixed load is applied.

The cables 100 and 100*a* according to the present invention, formed by arranging the cold-drawn shape memory alloy corrugated wires 132 having corrugations 134 on the surface of the cables 100 and 100*a*, have relatively high adhesion strength and corrugations distributed over the entire length, and thus require no fixing device to be installed at the end thereof, unlike the conventional post-tensioning technique.

The introduction of predetermined prestressing to the end of a concrete structure can be performed by a simple fixing plate used at the end of the concrete structure. This allows the concrete structure to be prestressed over a wide range at the end thereof.

When the cables 100 and 100*a* according to the present invention are used as a tendon, a method of re-tensioning in the PSC girder is as follows.

First, the cables 100 and 100*a* according to the present invention are tensioned at the beginning through a jack by using a sheath and a fixing device as in the conventional method.

Second, when the cables 100 and 100*a* according to the present invention are heated using electricity after the loss and reduction of prestress force occurs, recovery stress is generated, and accordingly, additional prestress force is introduced into the PSC girder.

Industrial Applicability

The recovery stress of the cable according to the present invention is variously applicable to the confinement of concrete, the closing and treatment of concrete cracks, the introduction of concrete prestressing, and the like.

What is claimed is:

1. A cable using cold-drawn shape memory alloy wires to be used in a construction site, the cable comprising:

a core wire configured by a cold-drawn shape memory alloy deformed by cold drawing to have an increased length; and a plurality of peripheral wires coupled to the core wire while being wound in a same direction along the circumference of the core wire, and configured by cold-drawn shape memory alloy deformed by cold drawing to have an increased length wherein the core wire is formed using a cold-drawn shape memory alloy straight wire configured straightly or a cold-drawn shape memory alloy corrugated wire having corrugations formed on a surface thereof, the plurality of peripheral wires are formed using cold-drawn shape memory alloy corrugated wires having corrugations formed on a surface thereof, and the cable is configured to be used while being confined in a concrete or in a cement composite material in the construction site, resulting that, in the construction site, there is no need to directly tensioning the cable to deform.

2. A combined cable having a first cable and a plurality of second cables according to claim 1, wherein the plurality of second cables are wound in a same direction along the circumference of the first cable.

* * * * *